US006094838A

United States Patent [19]

Lang

[11] Patent Number: 6,094,838

[45] Date of Patent: Aug. 1, 2000

[54] CURL AND PROFILE CORRECTION WITH HIGH VELOCITY HOODS

[75] Inventor: Ian G. Lang, Dewittville, Canada

[73] Assignee: Asea Brown Boveri Inc., Quebec, Canada

[21] Appl. No.: 09/086,022

[22] Filed: May 28, 1998

[30] Foreign Application Priority Data

May 28, 1997 [CA] Canada ..... 2206382

[51] Int. Cl.[7] ..... D06F 58/02

[52] U.S. Cl. ..... 34/117

[58] Field of Search ..... 34/117

[56] References Cited

U.S. PATENT DOCUMENTS

| | | | |
|---|---|---|---|
| 3,163,503 | 12/1964 | McKellar et al. | 34/122 |
| 3,167,408 | 1/1965 | Justus et al. | 34/122 |
| 3,183,607 | 5/1965 | Beachler | 34/122 |
| 3,208,158 | 9/1965 | Smith, Jr. | 34/122 |
| 3,377,056 | 4/1968 | Boye | 263/3 |
| 3,541,697 | 11/1970 | Villalobos | 34/115 |
| 3,570,137 | 3/1971 | Fleissner | 34/115 |
| 4,096,643 | 6/1978 | Futcher | 34/122 |
| 4,523,390 | 6/1985 | McCarthy | 34/115 |
| 5,416,979 | 5/1995 | Joiner | 34/114 |
| 5,495,678 | 3/1996 | Illmarinen et al. | 34/117 |
| 5,531,033 | 7/1996 | Smith et al. | 34/117 |
| 5,542,193 | 8/1996 | Sims et al. | 34/117 |
| 5,600,898 | 2/1997 | Deshpande et al. | 34/116 |

FOREIGN PATENT DOCUMENTS

| | | |
|---|---|---|
| 2101634 | 10/1993 | Canada . |
| 2136901 | 5/1995 | Canada . |
| 0655528 | 5/1995 | European Pat. Off. . |
| 9632534 | 10/1996 | WIPO . |

OTHER PUBLICATIONS

Defects Caused in Drying Paper—Notably Cockling and Curl—G. H. Nuttall pp. 277–285, Mar. 1997.

*Primary Examiner*—Henry Bennett
*Assistant Examiner*—Malik N. Drake
*Attorney, Agent, or Firm*—David L. Davis

[57] ABSTRACT

A method and apparatus for correcting the curl in drying and dried paper is presented wherein high velocity hoods are used in combination with drying cylinders. In addition, the use of impingement drying hoods provide a means to correct for variations in the moisture profile of the paper. High velocity hoods can be located in the drying section of a paper machine to compensate for uneven drying by paper cylinders.

8 Claims, 3 Drawing Sheets

CURL AND PROFILE CORRECTION WITH HIGH VELOCITY HOODS

FIELD OF THE INVENTION

This invention relates to paper drying and in particular to a method and apparatus to be used in the drying section of a paper machine to reduce curl in the finished product.

BACKGROUND OF THE INVENTION

A dryer section of a paper machine receives a paper web to be dried, from the forming end and pressing section of the paper machine. The web is conventionally dried on a plurality of dryer rolls heated by steam or gas so as to reduce the moisture content of the web to an acceptable percentage. The moving paper web travels over and with the drying cylinders which, conventionally, have been arranged in two tiers with one side of the web contacting one cylinder and then the other side of the web contacting the next cylinder.

In recent times, drying sections of paper machines have the drying cylinders grouped entirely or largely in single tiered sections with all or most of the drying being done or one side of the web only. This can cause uneven or one sided drying of the web which can lead to a bowing or curl of the paper web.

As an example of conventional practice, the drying of paper and board is generally carried out on a multitude of steam heated cylinders. In this typical drying process, the web enters the drying section at 40 to 50% solids and leaves at 90 to 95% solids. Historically, the drying cylinders have been arranged in two tiers with the wet web travelling over first one cylinder, then the next, with one side of the paper heated over one drum and the opposite side on the next. The process continues until the paper exits the dryers at the desired solids content.

As the paper travels over the cylinders, it is held onto the cylinder by means of a dryer fabric the purpose of which is to guide the paper over the dryer and hold it in intimate contact with the dryer surface.

The dryers are normally divided into groups of six to ten cylinders, each group having its own drive system. Likewise the dryers are grouped to provide sectional steam control to allow the drying temperature to be varied through the complete dryer section. Each drive group has its own dryer fabrics, one for the top dryers and one for the bottom dryers. In a two tier dryer, the web is held against the dryer only for the duration or wrap of the fabric in the dryer, approximately 180°. As the web passes from the one dryer to the next, it travels unsupported through the air (the draw) for a distance of several feet, until it reaches the next dryer and is then restrained by the fabric. While travelling through the draw, the web is susceptible to air movements which may cause the sheet to vibrate or flutter. If the aerodynamic forces acting on the web are high enough, the flutter may be sufficiently strong to cause the web to break which results in lost production while the broken paper (the broke) is removed and the web rethreaded through the machine.

Various solutions have been proposed to reduce sheet flutter in the dryer section and they have largely dealt with ways to reduce the length of the draw or unsupported length the paper must travel.

One solution is to use drying cylinders arranged in a single tier, with the conventional felt turn roll replaced with a larger vacuum roll. In this way the web travels restrained over one dryer then immediately over a turning roll which exerts a restraining force on the web, owing to the vacuum pressure acting on the back side of the web, then onto the next dryer and so on. In this way the unrestrained travel or draw is eliminated, the web stabilized and the detrimental aerodynamic effects minimized. The paper web can, in theory, be restrained through the duration of the drying process. Another advantage of this arrangement is that if the paper breaks in the drying section, the broke will automatically fall into the basement away from the machine, simplifying rethreading.

One drawback to this dryer arrangement is that it results in dryer sections that are very long compared to two tier dryer sections.

Another drawback to this solution arises from the one sidedness of the drying and is due largely to the formation of the paper web. The web is a mat of cellulose fibers which are more or less randomly oriented in the plane of the web, their orientation being dependent on the web formation. Likewise the paper web can be made up of two or more layers, each being comprised of different types of fiber, having different lengths and orientations.

As paper is dried, it tends to shrink. With the web being maintained in tension in the direction of the web travel, the shrinkage occurs in the width of the web, the majority of the shrinkage occurring as the web is dried from 60% solids to completion. The amount of cross machine shrinkage is proportional to the drying energy applied to the sheet.

In the case of a single tier drying section all of the drying energy is applied on one side of the sheet and as a result one side of the sheet tends to shrink more than the other. This non uniformity of shrinkage through the thickness of the web results in the web becoming bowed, a phenomena known as "curl". Curl is an undesirable condition as it leads to difficulties in the conversion of the web into a finished product, the "curled" web being more difficult to process than a flat web.

With two tiered dryers each side of the paper is dried more or less equally, however some degree of curl correction is often provided by having separate steam supply systems for the top and bottom dryers in one or more cylinder groups, curl correction being done by varying the shell temperature between the top and bottom dryers.

One method of avoiding curl is to dry on both sides which in a single tiered dryer section, requires that the dried side be reversed, at some point in the dryer section. Thus there is a series of dryer groups with the web dried on one side followed by another series of dryer groups with the web dried on the other side. However, this has some drawbacks from an operating stand point in that if the web should break in the section that has the felts on the bottom, the resulting broke must first be removed from the inside of the drying section before the sheet can be rethreaded, resulting in lost production time.

Another solution is to use dryers groups arranged in a single tier with the last section of dryers being a conventional two tiered dryer group. Although this entails the sheet travelling unsupported between the upper and lower tiers in the last section, the sheet, being largely dried at this location is sufficiently strong to resist the aerodynamic forces.

Still other solutions use a total single tier dryer section with curl correction taking place after the dryers by means of using steam shower to rehumidify the sheet and thus release some of the stresses in the web caused by the non-uniform drying.

This solution may be less than desirable because in order to have a dry web at the end of the process, the web must first be over dried in the dryer section, prior to rehumidification, which may result in a loss of production capacity.

The need for a solution to this curl problem has long been required. One proposed solution is found in a paper entitled "Defects Caused In Drying Paper—Notably Cockling And Curl" by G. H. Nuttall published in a book entitled "Drying Of Paper And Paperboard" 1972, Lockwood Publishing Co. Inc. This paper discloses several key causes of curl in paper web and it suggests possible solutions.

U.S. Pat. No. 5,600,898, Feb. 11, 1997, Deshpande et al, discloses a paper dryer for a single tier of top-felted dryer rolls which, in combination with air caps, simultaneously dry both sides of a web. The air caps are in the form of hoods which overlie the upper portions of the dryer rolls and blow high velocity hot air through the felts to dry the upper surface of the web, preferably at the same rate as the roll side of the paper is dried by steam heat transmitted to the surfaces of the dryer rolls.

U.S. Pat. No. 5,542,193, Beloit deals with a dryer group for controlling curl in the web. This is carried out by two separate groups of dryers. The patent discloses the use of a main line of single tier dryers to dry the first side of the web and then there is a further drying section which includes an upper tier of dryers and a lower tier of dryers to dry the second side of the web. A plurality of vacuum transfer rolls each of which is connected to a source of partial vacuum so that during the movement of the web around each of the vacuum transfer rolls the web is held against cross-machine and machine directional shrinkage. This patent also refers to the inclusion of control means to control the steam pressure within each dryer of the upper and lower tier thereof so that any tendency of the web to curl due to cross-machine directional shrinkage of the web is compensated for by the application of differential steam pressure.

Canadian Published application 2,136,901, Valmet, suggests several ways to dry the side of a web opposite to that which is dried on the face of the dryer drums. In one example the use of an infrared device is disclosed and the possible use of microwave or RF radiators are discussed. It is also suggested that it is possible to use devices for the blowing of drying air, such as a blow device, by means of which air jets are applied to the upper surface of the web.

Other patents of interest are as follows:

U.S. Pat. No. 4,523,390, Jun. 18, 1985 which discloses a peripheral exhaust system for a high velocity dryer having dryer hood sections.

U.S. Pat. No. 4,096,643, Jun. 27, 1978, Dominion Engineering Works, discloses a paper web drying system having a series of adjacent compartments extending transversely across the web guide with means to provide moisture profiling by varying the quantity, velocity and temperature of the drying medium.

U.S. Pat. No. 3,570,137 shows an apparatus for the continuous treatment of a web which encloses one or more web cylinders.

U.S. Pat. No. 3,183,607, May 18, 1985 discloses a drying hood having a movable plenum construction.

Other U.S. Patents which may be of interest to the reader are U.S. Pat. Nos. 3,208,158; 3,541,697; 3,377,056; 3,167,408; and 3,163,503. These disclose dryer hoods having plural headers for applying drying medium to their associated webs.

SUMMARY THE INVENTION

This invention relates to a high velocity hood mounted adjacent to a drying cylinder on the opposite side of the paper web which is in contact with the drying cylinder. The arrangement is such as to transfer heat and thus to effect evaporation of water in the web on the side opposite the cylinder heated side. The effect of drying with the high velocity hood is to correct the uneven drying caused by drying the web totally or largely on one side with cylinders. The addition of high velocity hoods to the side opposite the cylinder from a point in the dryer section where the web is approximately 60% solids, will equalize the evaporation on both sides and eliminate the forces which result in curl.

The Valmet published application referred to above fails to disclose a combination of elements as described in the following specification. In the present invention, air is blown through a dryer fabric to transfer heat to the top side of the web for drying. The Valmet published application refers to ventilating the pores of the fabric to reduce the vapor pressure and increase evaporation. The patent therefore seems to be directed more to improving ventilation then to enhance evaporation. The published application also makes reference to the use of using hot dry air to effect the drying of the felt but the use of "dry air" would be extremely energy intensive. In the present invention, some or most of the drying air would be recirculated to improve economy.

With respect to U.S. Pat. No. 5,600,898 this reference makes no mention of the provision for cross-machine profiling, a feature of the present invention. The present invention also may be used on bottom felted dryers or two tier dryers where ever there is a need to correct uneven drying. This would not be possible with the U.S. Patent in question. Moreover, there is no reference in this U.S. Patent for the provision of a retraction system to facilitate broke removal, a feature of the present invention.

High velocity hoods are a well known element in web drying processes. The hood is an air distribution and drying system shaped to be installed over (or under) a drying cylinder, which conveys and directs high velocity jets of hot drying air onto the web travelling over the cylinder.

The application of high velocity hoods over the drying cylinders can provide sufficient two-sided drying to reduce or eliminate the curl effect associated with uneven or one-sided drying.

To provide a further degree of control, the internal air distribution system may be divided into compartments across the width of the web. This allows a control of the drying supplied across the back of the web. Compartmentalising the hood air distribution system in the cross machine direction provides a further benefit in that it allows for correction of variations of cross machine moisture profile. In addition, the drying effected by the impingement hood is additive to that contributed by the cylinders which allows for increases in machine speed or alternatively a dryer section shorter in length than one comprised solely of cylinders.

Another advantage of the high velocity hood is that the amount of drying energy supplied can be varied quickly by raising or increasing the temperature of the drying air. In contrast, the time to vary the drying energy with steam cylinders is very slow owing to the huge thermal inertia of the cast iron drum. Therefore the high velocity hood may be used to provide correction for variations in the machine direction moisture profile.

The use of the high velocity hood applies equally for double tier dryer sections as well as single tier (top or bottom felted), where there is a requirement to dry preferentially one side of the paper web to correct for uneven drying with cylinders.

The high velocity hood may also be used as a tool to help improve the runnability of the paper web through the drying section by using to advantage air jets in the leaving and entering nozzle boxes to eliminate or greatly reduce the boundary layer of air that is entrained by the moving fabric and in addition act as a suction plenum to maintain a negative pressure in the space defined by adjacent drying cylinders and intermediate turning rolls.

BRIEF DESCRIPTION OF THE DRAWINGS

The invention is illustrated by way of example in the accompanying drawings in which.

DESCRIPTION OF A PREFERRED EMBODIMENT

Figure 1:
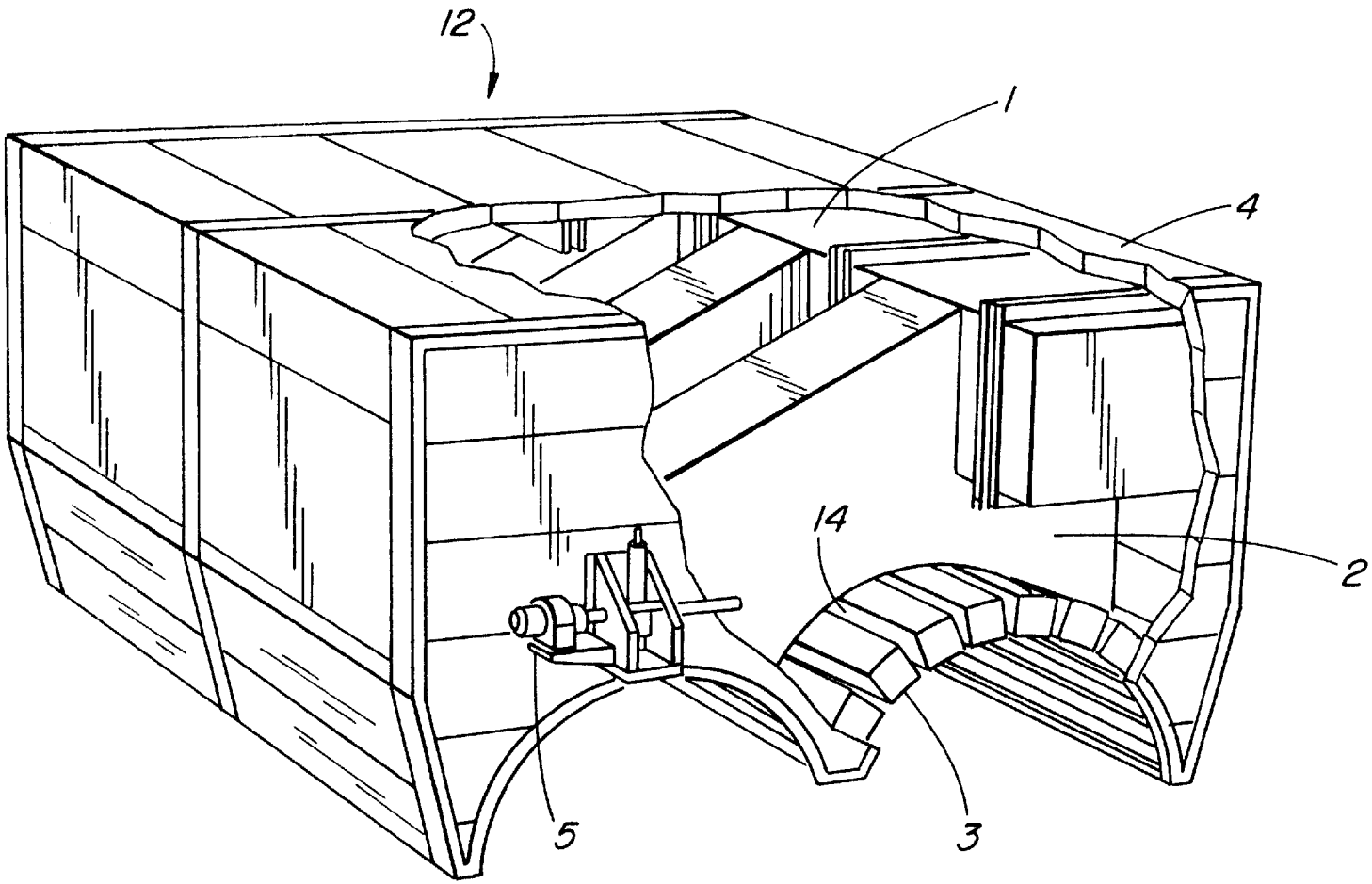
FIG. 1 is a sectional view showing the internal air distribution system of the hood.

Referring to FIG. 1, hot drying air is supplied to the hood 12 from a system of ducts with a circulating fan, heating system (either steam heating coils or burner) not shown here. Alternatively, the hood can be supplied with internally mounted fans and burners or coils and in that way reduce the amount of space required for external ducting. One form of hood is described in Applicant's U.S. Pat. No. 5,531,033 issued Jul. 2, 1996, "Controlled Profile Drying Hood". See also Applicant's U.S. Pat. No. 5,784,804 "Yankee Hood with Integral Air Heating System".

Figure 2:
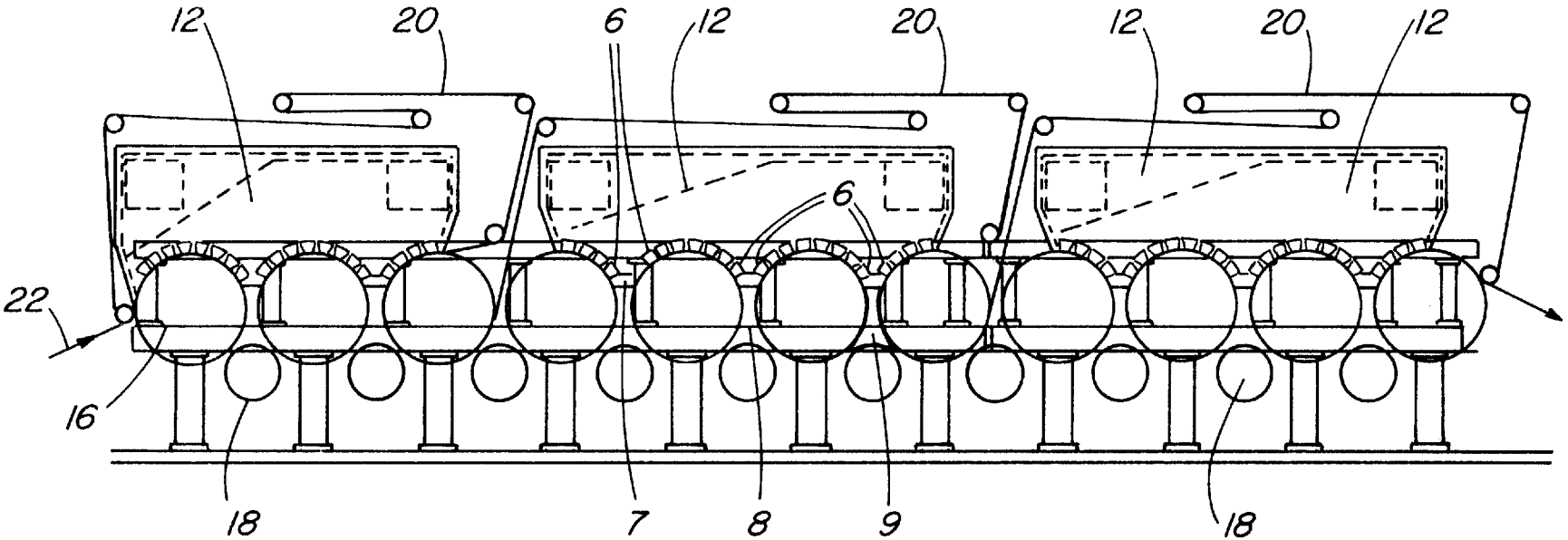
FIG. 2 is a schematic side elevation which shows an arrangement of a single tier drying section in conjunction with high velocity hoods according to the invention.

The air enters the supply header 1 and is delivered through a plurality of distribution headers 2 to nozzle boxes 3, having a rectangular cross section, and which run transverse to the web and are arrayed around the perimeter of the dryer cylinder, generally between 90 and 240 degrees as shown in FIG. 2. The front face of the nozzle boxes are perforated, whereby the impinging drying air blows onto the paper web. The gap 14 between adjacent nozzle boxes serves as a return channel for the spent drying air which is under a negative pressure owing to its connection to the suction side of the circulating fan.

As shown in FIG. 2, a typical drying section of a paper machine incorporates a plurality of parallel, single tier cylindrical dryers 16 and a plurality of turning rolls 18 are dispersed along the single tier of drying cylinders, one turning roll intermediate each pair of cylinders 16. Several fabrics 20 are dispersed throughout the length of the dryer in order to carry the paper web 22 along the series of drying drums and turn rolls.

One or more drying hoods 12 are arranged along the upper surfaces of the drying cylinders as illustrated and these hoods 12 may take the form of multiple units acting in combination with one or more of the dryer cylinders as shown.

It is desirable to eliminate or reduce as much as possible the amount of air entrained in the dryer fabric 20 as it leaves each cylinder 16 moving toward the next turn roll 18 as the air flow into the space tends to pressurize the space defined by two adjacent cylinders 16 and the intermediate turn roll (or rolls) 18, a negative pressure being desirable to help support the web 22 against the dryer fabric.

To achieve this effect the first and last nozzle boxes 6 in the hood 12 utilize a slot jet 24 running the full width of the paper web directed at an angle to the web so as to achieve the effect of separating the boundary layer of air attached to the moving fabric 20.

Figure 3:
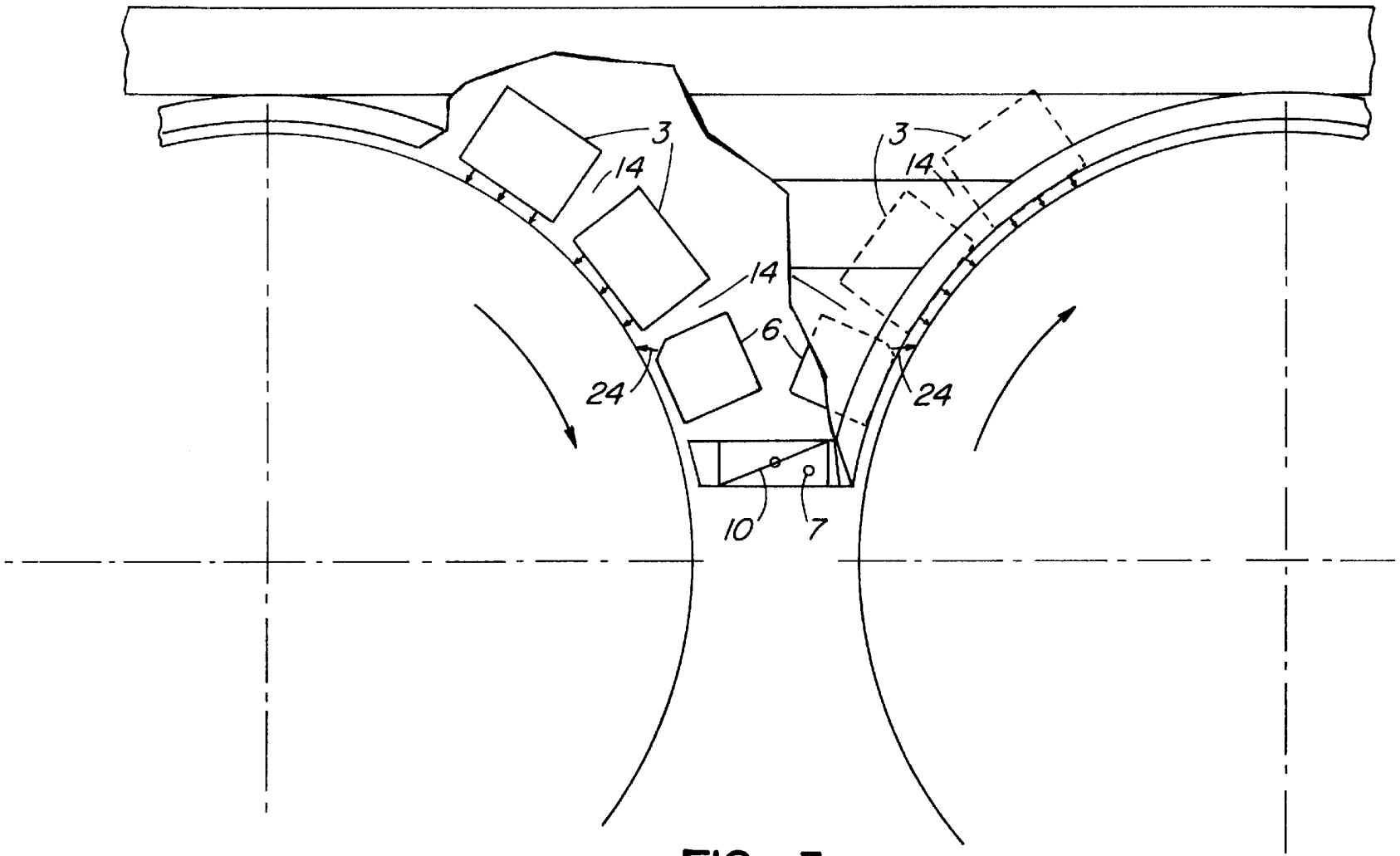
FIG. 3 is a sectional view of the apparatus showing the arrangement of the first and last nozzle boxes with slot jets and a return air opening.

Between adjacent cylinders 16 an opening 7 in the hood 12 running the width of the paper web serves to evacuate the air in the space 8 defined by adjacent cylinders 16 and their intermediate turn roll 18 as shown in FIG. 3. This opening 7 is equipped with a damper 10 to permit adjustment of the amount of suction applied, the source of this suction being the circulating fan of the high velocity hood. The space defined by adjacent cylinders 16 and the intermediate turn roll 18 may be closed at the ends by means of plates 9 suspended from the hood to reduce the amount of air which must be removed to maintain a negative pressure in the space.

To enable cross-machine moisture profiling, the individual distribution headers 2 would be fitted with a damper (not shown), to permit regulation of the air flow to the transverse nozzle boxes 3. Each distribution header 2 feeds the nozzles wrapping the cylinder or cylinders, the nozzles being divided into sections in the cross machine direction to permit drying control under that one section. The dampers 10 would be operated either manually or by means of an electric or pneumatic actuator.

The air is then evacuated from under the nozzle boxes 3 into the interior of the hood 12 not occupied by the air distribution system and from the hood directed back to the air circulation and heating system.

A portion of the returning air which is laden with water vapour from evaporation is exhausted away from the air circulating system to atmosphere or to a suitable heat recovery system to recover the heat contained in the air stream.

The outside of the hood 12 itself is suitably sealed and insulated as at 4 to make it airtight and to minimize heat loss to the surrounds.

A retraction mechanism 5 consisting of the appropriate mechanical, electric, pneumatic or hydraulic actuators is provided to raise (or lower) the hood 12 away from the cylinder 16 to provide clearance for broke removal, fabric replacement and maintenance.

The operation of the burners and dampers would be governed by a suitable control system which would regulate the amount of drying in response to the amount of correction required.

As shown in FIG. 2, each hood covers two drying cylinders 16 but it could be designed to cover one cylinder or more than two and in practice the size of the hood will be dictated by the amount of surface area for drying required and the space limitations on the machine.

The quantity of hoods would be determined by the overall drying requirements and by the amount of drying required to effect curl and profile correction.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

I claim:

1. A method of drying a travelling paper web in a dryer section of a paper machine having a plurality of drying cylinders arranged in spaced, parallel relationship with at least one return roll below the center line of each pair of drying cylinders, comprising the steps of:

a) passing said web over and against the surface of said drying cylinders to dry one side of the web;

b) simultaneously subjecting the other, top side of the web to a plurality of jets of hot drying air from a high velocity hood mounted adjacent the top surfaces of said drying cylinders thereby to substantially dry both sides of said web evenly;

c) providing cross-machine direction profiling to said hot drying air from damper means in said hood;

d) providing said hot drying air with machine-direction, moisture variation correction from means in said hood; and e) positioning selected nozzle boxes in said hood adjacent the inlet and outlet thereof to direct jets at an angle to said paper web to separate a boundary layer of air attached to a fabric travelling with said web.

2. A method according to claim 1 wherein said selected nozzle boxes are the first and last nozzle boxes in said hood and each having a jet slot running the full width of the paper web.

3. A method according to claim 1 wherein said plurality of drying cylinders are arranged in a single tier.

4. A method according to claim 1 wherein said plurality of drying cylinders are arranged in more than one tier.

5. Apparatus for drying a paper web in the dryer section of a paper machine, said machine having at least one tier of drying cylinders arranged in spaced, parallel relationship with at least one return roll located intermediate each pair of drying cylinders and below the center line thereof, said apparatus comprising a high velocity hood mounted adjacent the upper surfaces of said drying cylinders to transfer heat to the paper web on the surface thereof opposite the side of the web which is in contact with said dryer cylinders, said hood having a plurality of nozzle boxes extending transverse to said web and arranged around the perimeter of said dryer cylinders; means for blowing hot, drying air through said nozzle boxes onto said paper web, a gap between adjacent nozzle boxes to provide return channels for spent drying air, damper means in said hood to provide cross-machine direction profiling and means to provide machine direction moisture variation correction.

6. Apparatus according to claim 5 wherein said drying cylinders are arranged in a single tier.

7. Apparatus according to claim 5 wherein said high velocity hood includes select nozzle boxes, adjacent the hood inlet and outlet, and having air knives directed angularly toward said web to separate a boundary layer of air attached to a fabric travelling with said web.

8. Apparatus according to claim 7 wherein said select nozzle boxes have a jet slot running the width of said web and angled toward said web, said air knives comprising the jets angularly directed by said slots.

* * * * *